United States Patent [19]

Schlegel

[11] Patent Number: 5,058,862

[45] Date of Patent: Oct. 22, 1991

[54] NAIL REMOVING TOOL

[76] Inventor: Thomas K. Schlegel, 19 Snow Ct., Dearborn, Mich. 48124

[21] Appl. No.: 593,317

[22] Filed: Oct. 1, 1990

Related U.S. Application Data

[63] Continuation of Ser. No. 407,326, Sep. 14, 1989, abandoned.

[51] Int. Cl.[5] ..... B66F 15/00

[52] U.S. Cl. ..... 254/26 R

[58] Field of Search ..... 254/26, 26 R, 26 E, 254/27, 21, 131, 94; 29/267

[56] References Cited

U.S. PATENT DOCUMENTS

| | | | |
|---|---|---|---|
| D. 15,422 | 9/1884 | Allyn | 254/26 R |
| D. 42,279 | 3/1912 | Gillet | 254/25 |
| 148,664 | 3/1874 | Buell | 254/27 |
| 696,292 | 3/1902 | Woodhouse | 254/25 |
| 821,404 | 5/1906 | Craft | 254/27 |
| 900,338 | 10/1908 | Wolfe . | |
| 1,580,913 | 4/1926 | McLain . | |
| 1,792,437 | 2/1931 | Metzger et al. . | |
| 1,934,706 | 11/1933 | Green . | |
| 2,001,868 | 5/1935 | Crandall | 254/26 R |
| 2,231,206 | 2/1941 | Anderson . | |
| 2,330,092 | 9/1943 | Vanasse | 254/26 R |
| 2,539,860 | 1/1951 | Ralston | 254/26 R |
| 2,698,161 | 12/1954 | Kirby | 254/130 |
| 3,138,364 | 6/1964 | Cory . | |
| 3,169,010 | 2/1965 | Crawford . | |
| 3,281,117 | 10/1966 | Ahearn . | |
| 3,680,838 | 8/1972 | Dunn | 29/267 |
| 3,885,772 | 5/1975 | Balkus . | |
| 4,290,583 | 9/1981 | Lombardi . | |
| 4,423,620 | 12/1983 | Nitzberg . | |
| 4,533,116 | 8/1985 | Panovic . | |
| 4,576,361 | 3/1986 | Knight . | |

FOREIGN PATENT DOCUMENTS

| | | | |
|---|---|---|---|
| 328278 | 4/1930 | United Kingdom | 254/94 |

*Primary Examiner*—Robert C. Watson

*Attorney, Agent, or Firm*—Gifford, Groh, Sprinkle, Patmore and Anderson

[57] ABSTRACT

A nail removing tool comprises a handle, a tool head having nail-removing claws, and at least one roller rotatably mounted to the top side of the tool head in at least one channel defined therein. The roller includes an outer ring preferably composed of a flexibly resilient polymerized material. The tip portions of the claws include a pair of inwardly-facing and opposing bevelled surfaces which proximally terminate at a pair of inclined ledges for pivoting the head of a nail thereon as the nail is removed.

5 Claims, 2 Drawing Sheets

NAIL REMOVING TOOL

This is a continuation of copending application Ser. No. 07/407,326 filed on Sept. 14, 1989, now abandoned.

BACKGROUND OF THE INVENTION

I. Field of the Invention

The present invention relates to nail removing tools. More particularly, the present invention relates to a nail removing tool having at least one roller rotatably mounted in the top side thereof.

II. Description of the Relevant Art

Very often it is desirable for a woodworker to remove a nail from a piece of wood because the nail was improperly selected or improperly placed. To aid in the removal of the nail, claw-fitted tools have been employed, such as claw hammers or crowbars.

Common claw hammers and crowbars suffer from a significant disadvantage in that they have a pronounced tendency of bending nails as they are withdrawn. The reason for this is that the hammer head is curved, and the peak of the head of the curved hammer acts as the fulcrum. However, the fulcrum does not move, and while the selected nail is withdrawn, the nail head is pulled upward and toward the fulcrum resulting in increased friction due to the changing angle of the resultant force. The withdrawn nail is, as a result, invariably bent.

In an effort to minimize the bending of the nail, a common practice that is often taught in handbooks is to place a selected piece of wood under the hammer head to increase the working leverage while simultaneously protecting the workpiece. While this approach more or less improves the situation, the fulcrum still does not move, and a bent nail is still the typical result.

Some efforts have been taken toward eliminating this problem by providing adjustable fulcrums, levers and the like. However, because of the complexity and ineffectiveness of these known nail removing tools, none of these devices has become useful or popular because the nail more or less is still bent upon withdrawal.

Accordingly, prior approaches to providing a tool for removing a nail have failed to eliminate the problem of not being able to remove a nail without its being bent. Prior approaches have also failed to eliminate the need for the piece of wood for increasing leverage while simultaneously protecting the workpiece. Earlier answers have attacked only the symptoms of the problem, not the cause.

SUMMARY OF THE PRESENT INVENTION

The present invention provides a nail removing tool which includes a movable fulcrum that compensates for the claw angle necessary to remove a nail.

The tool of the present invention includes a handle, a tool head having nail-removing claws, and at least one roller rotatably mounted to the top side of the tool head. More than one roller may be mounted thereon.

Each of the rollers is rotatably mounted in a channel defined in the top side of the tool head. The roller includes an outer ring composed of a flexibly resilient polymerized material. This construction allows the part of the roller to flatten slightly as the roller is engaged against the work piece when a nail is being removed. This flattening prevents indentation, grooving or marring of the work piece.

At the ends of the claws are defined a pair of inwardly facing bevelled surfaces. These surfaces accommodate the head of the nail as the tool is engaged in the nail removing position. Inwardly and proximally terminating at the inward ends of the bevelled surfaces are a pair of inclined ledges. The ledges operate to receive the head of the nail which pivots thereon.

To use the tool, the claw portion is directed under the nail head of the nail selected for removal. The underside of the nail head is rested upon the bevelled surfaces, and force is applied to the tool's handle in a direction away from the nail, causing the roller to act as a fulcrum.

As the nail is withdrawn, the head of the tool is allowed to move, by means of the roller, toward the nail, whereby the increasing incline of the claws required for the elevation of the nail head is compensated for by the altered position of the fulcrum.

When the nail is nearing its fully withdrawn position, the underside of the nail head shifts from resting upon the bevelled surfaces to the inclined ledges, where it pivots thereon until the nail is fully withdrawn. The result is a nail that has not been bent. This is the case even when nails have been driven into the workpiece at an incline relative to the plane of the wood because the head of the tool of the present invention substantially compensates for the incline.

Of importance is the fact that the effort required for removing the nail is reduced concurrent with the reduced friction encountered by the withdrawn nail.

Other advantages and features of the present invention will become apparent from the following detailed description when read in conjunction with the accompanying drawing.

BRIEF DESCRIPTION OF THE DRAWING

The present invention will become more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
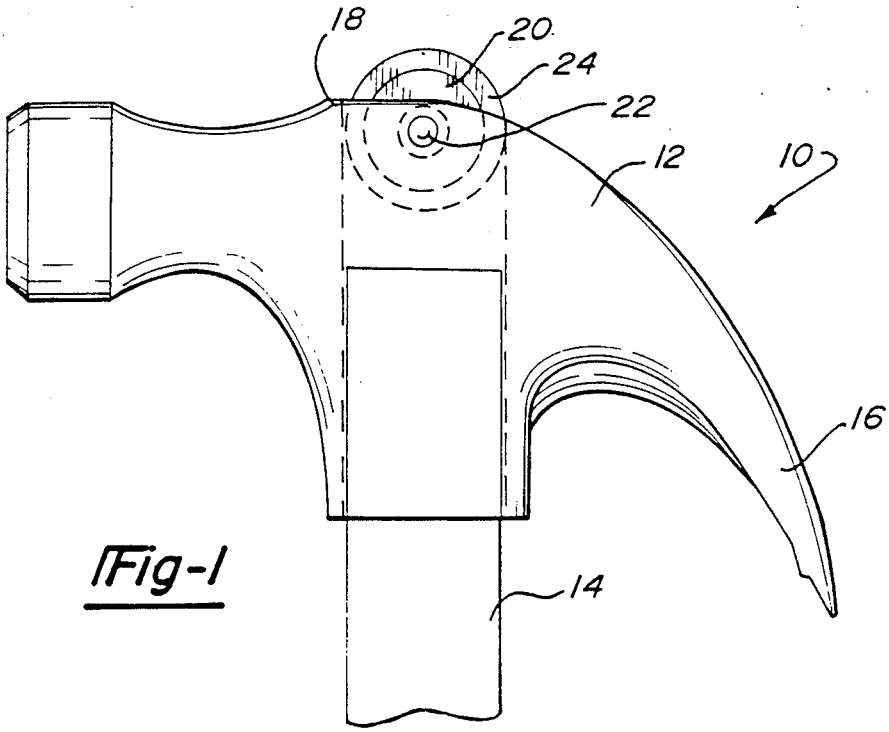
FIG. 1 is a partial side view of a nail removing tool according to the present invention.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a partial side view of the tool according to the present invention is portrayed, generally indicated as 10. The tool 10 includes a head portion 12 and a handle portion 14. Alternatively, the tool 10 may be one-pieced forged steel and may include a cavity therein to reduce weight. The head portion 12 is illustrated here as being a claw hammer head, but it must be understood that the tool 10 of the present invention may be configured somewhat differently and may be more like that configured as a crowbar or the like. The important feature here is that the tool 10 has at least one pair of claws 16 and a roller region 18.

The roller region 18 includes at least one roller 20 pivotably mounted to the roller region 18 by a pin 22. Preferably the roller 20 includes an exterior layer ring 24 composed of a flexibly elastic polymerized material. The roller 20 may be provided singularly or may be provided as a pair of rollers in a side-by-side manner (not shown) mounted perpendicularly with respect to the axis of the head 12.

Figure 2:
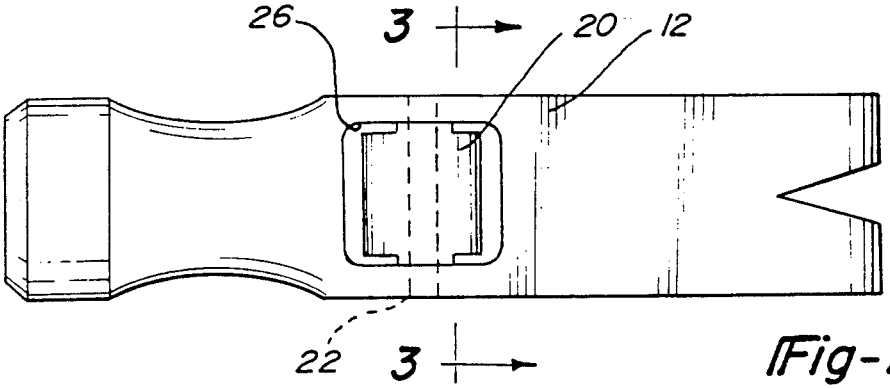
FIG. 2 is a top plan view of the view of FIG. 1.

Referring to FIG. 2, the top side of the head 12 is illustrated. This view better illustrates the position of the roller 20 with respect thereto. The roller 20 is rotatably mounted within a roller channel 26.

Figure 3:
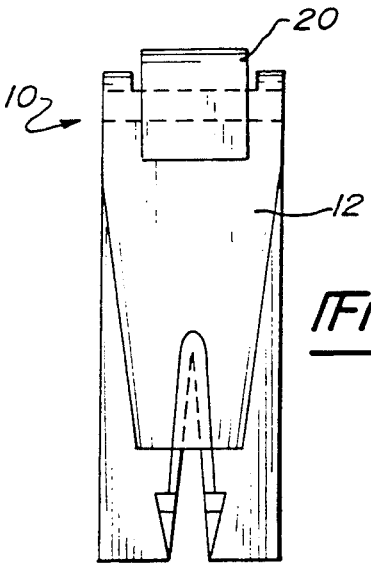
FIG. 3 is a view taken along lines 3—3 of FIG. 2.

FIG. 3 illustrates a view taken along lines 3—3 of FIG. 2 and illustrates the front end of the head 12 of the tool 10 to better show the relationship of the roller 20 with respect to the head 12.

Figure 4:
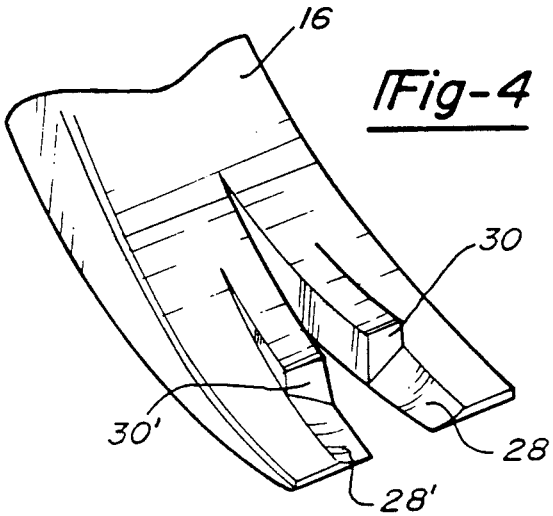
FIG. 4 is a detailed view illustrating the underside of the claw of the present invention.

Referring to FIG. 4, the underside of the ends of the claws 16 is illustrated. At the ends of the claws 16 are defined a pair of inwardly-facing bevelled surfaces 28, 28'. It is upon the surfaces 28, 28' that the underside of the nail head initially rests when the nail removing process is begun.

At the interior or proximal ends of the surfaces 28, 28' are defined a pair of inclined ledges 30, 30'. It is upon the ledges 30, 30' that the underside of the nail head ultimately pivots as the user approaches the end of the nail removing process.

Of course, the pitch and degree of the bevel of the surfaces 28, 28' and the ledges 30, 30' may be configured as necessary depending upon the nails to be removed, the shape of the claws, etc. In any event, preferably the first ½-inch of the claw end portion has the bevelled surfaces 28, 28' defined thereon.

Figure 5:
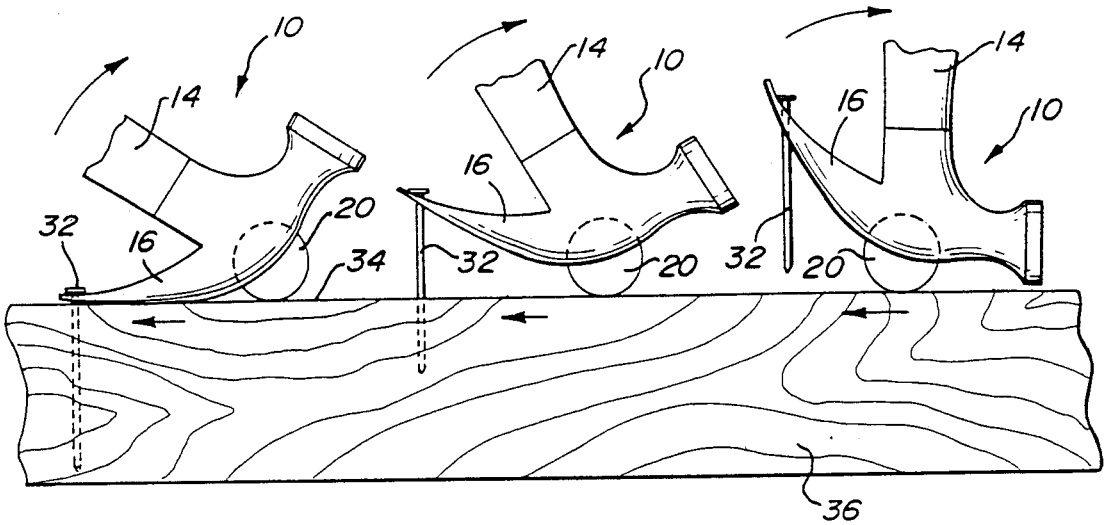
FIG. 5 is an illustration of multiple views illustrating the steps of using the tool of the present invention as a nail is progressively removed thereby.

Referring to FIG. 5, progressive, multiple views of the tool 10 engaged to remove a nail 32 is illustrated.

In the first stage, the tip of the claw 16 is fitted under the head of the nail 32 whereby the bevelled surfaces 28, 28' contact the underside of the head of the nail 32. The roller 20 rests upon and coacts with an upper surface 34 of a piece of wood or other construction material 36.

In the second stage, force is applied to the handle 14 in a direction substantially away from the nail 32. The roller 20, now fully engaged as a fulcrum, moves toward the nail 32 to compensate for the increasing angle of the claw 16. The underside of the head of the nail 32 at this point begins to engage the ledges 30, 30' and begins to pivot thereon.

In the third and final stage of the nail removing process, the nail 32 is fully withdrawn and is not bent. The roller 20 has proceeded to its point closest to the withdrawal point of the nail 32, and the underside of the head of the nail 32 has fully pivoted upon the ledges 30, 30' of the claws 16.

Figure 6:
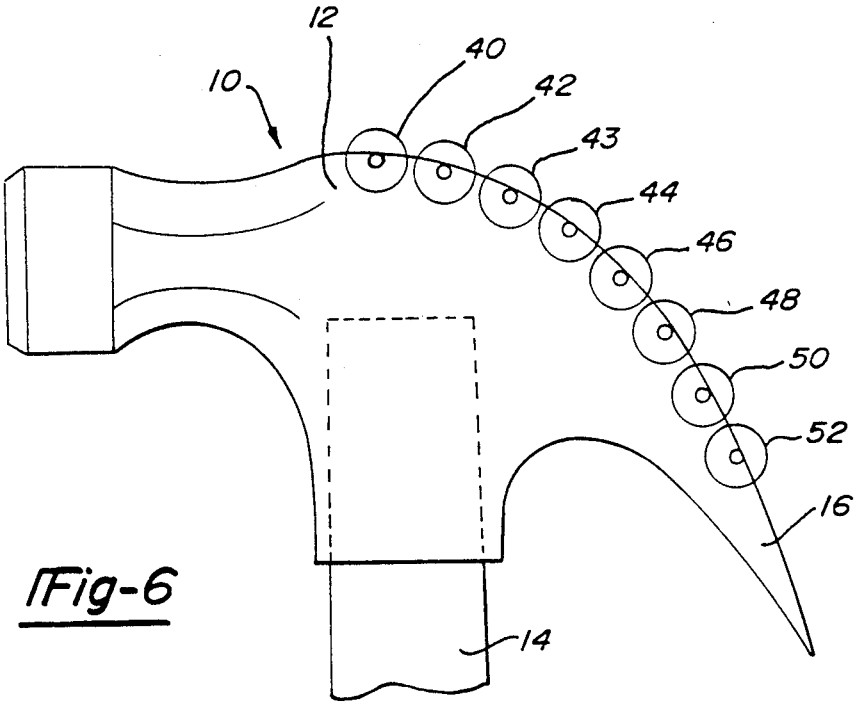
FIG. 6 is an alternate embodiment of the present invention illustrating a side view of the tool head having more than one roller.

Referring to FIG. 6, an alternate embodiment of the tool 10 is illustrated having a number of rollers 40, 42, 44, 46, 48, 50, 52 rotatably fitted thereto. The additional rollers 40, 42, 44, 46, 48, 50, 52 may be all included, or any number may be included. The extra rollers 40, 42, 44, 46, 48, 50, 52 act as additional fulcrums as may be preferred for longer nails. Like the roller 20, the rollers 40, 42, 44, 46, 48, 50, 52 may be provided singularly resulting in a single line relative to the axis of the head 12 or may be provided in pairs, resulting in two rows (not shown).

Having described my invention, however, many modifications thereto will become apparent to those skilled in the art to which it pertains without deviation from the spirit of the invention as defined by the scope of the appended claims.

I claim:

1. A hammer comprising:

an elongated handle having opposed ends and a longitudinal axis extending between said opposed ends;

a hammer head mounted transversely to one end of said handle;

said hammer head having opposed ends and a longitudinal axis perpendicular to and intersecting the longitudinal axis of said handle;

a head portion formed at one end of said hammer head and a claw portion formed at the opposite end;

a recess formed in said head portion of said hammer head;

a roller rotatably carried in said recess, said midpoint of said roller being positioned at a point beneath the surface of said hammer head so that only a portion of said roller protrudes from said hammer head; said roller having an axis of rotation perpendicular to said longitudinal axis of said handle, said roller axis further intersecting said longitudinal axis of said elongated handle; and said claw portion terminating in opposed and inwardly-facing bevelled surfaces, said bevelled surfaces having inclined ledges at an interior end thereof.

2. The hammer of claim 1, wherein at least on said roller is rotatably carried in at least one said recess defined in a longitudinal row relative to said claw portion.

3. The hammer of claim 1 wherein said claw portion includes a sloping top side.

4. The hammer of claim 1 wherein said roller includes a ring composed of a flexibly resilient polymerized material.

5. The hammer of claim 4 wherein said material is nylon.

* * * * *